US011027295B2

(12) United States Patent
Gunn

(10) Patent No.: US 11,027,295 B2
(45) Date of Patent: Jun. 8, 2021

(54) SPRAY APPLICATOR

(71) Applicant: David T. Gunn, Arvada, CO (US)

(72) Inventor: David T. Gunn, Arvada, CO (US)

( * ) Notice: Subject to any disclaimer, the term of this patent is extended or adjusted under 35 U.S.C. 154(b) by 459 days.

(21) Appl. No.: 16/124,203

(22) Filed: Sep. 7, 2018

(65) Prior Publication Data

US 2019/0076861 A1 Mar. 14, 2019

Related U.S. Application Data

(60) Provisional application No. 62/555,871, filed on Sep. 8, 2017.

(51) Int. Cl.

| | |
|---|---|
| ***B05B 7/04*** | (2006.01) |
| ***B65D 83/66*** | (2006.01) |
| ***B05B 7/24*** | (2006.01) |
| ***B05B 15/63*** | (2018.01) |
| ***B05C 17/005*** | (2006.01) |
| ***B05B 15/55*** | (2018.01) |
| *B05C 17/01* | (2006.01) |

(52) U.S. Cl.

CPC ..... *B05B 7/0475* (2013.01); *B05B 7/0458* (2013.01); *B05B 7/0491* (2013.01); *B05B 7/2416* (2013.01); *B05B 7/2435* (2013.01); *B05B 7/2467* (2013.01); *B05B 7/2489* (2013.01); *B05B 15/55* (2018.02); *B05B 15/63* (2018.02); *B05C 17/00576* (2013.01); *B65D 83/663* (2013.01); *B05C 17/00596* (2013.01); *B05C 17/0103* (2013.01); *B05C 17/0126* (2013.01)

(58) Field of Classification Search

CPC ..... B05B 7/045; B05B 7/0458; B05B 7/0475; B05B 7/0491; B05B 7/2435; B05B 7/2467; B05B 7/2489; B05B 15/531; B65D 83/66; B65D 83/663; B05C 17/00576; B05C 17/00596

See application file for complete search history.

(56) References Cited

U.S. PATENT DOCUMENTS 4,174,068 A * 11/1979 Rudolph ..... B05B 7/2437 222/327

4,951,876 A 8/1990 Mills (Continued)

*Primary Examiner* — Ryan A Reis

(74) *Attorney, Agent, or Firm* — Kyle W. Rost

(57) ABSTRACT

A spray applicator assembly discharges distributable product from a cartridge using low air pressure. The cartridge is held captive between a piston advancing from the rear to expel contents and a nozzle snugly attached at the front to receive expelled contents and to convert the contents into droplets by subjecting the contents to an array of focused high velocity air streams. The nozzle has an open barrel design and is able to discharge a variety of liquid or viscous distributable product without readjustment, other than resetting a proportioning valve in the low pressure air feed line. An air chamber immediately in front of the cartridge nose provides constant backpressure, which dominates to cleanly stop flow of distributable product into the nozzle whenever the piston stops advancing. When the piston resumes advancement, the flow restarts cleanly. Clean stopping and starting saves distributable product from waste. Variations in the distributable product might include, without limitation, a broad variety of materials including coating materials and combustibles.

19 Claims, 5 Drawing Sheets

(56) References Cited

U.S. PATENT DOCUMENTS

| | | | | |
|---|---|---|---|---|
| 5,536,531 | A * | 7/1996 | Owen | B05B 7/2437 427/256 |
| 6,095,435 | A | 8/2000 | Greer, Jr. et al. | |
| 6,161,778 | A * | 12/2000 | Haruch | B05B 7/0458 239/290 |
| 7,163,130 | B2 * | 1/2007 | Lafond | B05C 17/00503 222/326 |
| 8,028,934 | B2 * | 10/2011 | Wurz | B05B 7/0458 239/434 |

* cited by examiner

SPRAY APPLICATOR

BACKGROUND OF THE INVENTION

Field of the Invention

The invention generally relates to spraying apparatus and to nozzles. More specifically, the invention relates to discharging of fluent materials from two or more sources. In another aspect, the invention relates to fluid spraying and diffusing. More specifically, the invention relates to combining separately supplied fluids at or beyond an outlet, where fluid streams have an angular junction.

Description of Related Art

Current spray technologies require a user to leave the target surface to shut down the materials flow after each swath of spray. Similarly, starting or restarting a spray is done off-target in order to establish satisfactory spray characteristics before moving on-target. These practices waste approximately 30% of the materials. Thus, a 30% waste factor is an accepted fault of current spray technologies.

One reason why standard spray technologies have such a high waste factor is the use choked flow fluid dynamics to produce the spray with a convergent-divergent nozzle. A convergent-divergent nozzle employs a mixing chamber, where air and materials meet, behind the nozzle tip. The tip is configured with a smaller orifice hole in the center of the tip, creating a severe restriction. This configuration utilizes the conservation of mass principle to create a spray. Conservation of mass requires fluid velocity to increase as the fluid flows through the significantly smaller cross sectional area of the restriction, powered by compressed air, forcing the materials through the small hole in the tip to create a spray. Starting or stopping the spray process is characterized by errors in the spray pattern, largely due to the time factor necessary to build or dissipate pressure behind the very small, convergent-divergent orifice of the nozzle.

Modern spray fluids such as certain vinyl compounds can be heavy, thixotropic compounds. Thixotropy is a time-dependent shear thinning property. Certain gels or fluids that are thick or viscous under static conditions will flow, becoming thin and less viscous, over time when shaken, agitated, or otherwise stressed, thus displaying time dependent viscosity. Thixotropic compounds then take a fixed time to return to a more viscous state. These high viscosity, non-Newtonian vinyl compounds will usually create errors with sprayers employing convergent-divergent nozzle technology.

The spray properties of thixotropic compounds and non-Newtonian compounds such as certain vinyl compounds are significantly different from Newtonian compounds. With conventional spray technology, switching from spraying a Newtonian compound to a non-Newtonian compound can require the user to change the spray nozzle or even the entire sprayer and air compressor.

Although many applications of spray technology related to the construction industry, spray technology also can relate to fuels and delivery of fuels. It would be desirable to have a spray applicator that is able to spray fuels such as diesel fuel for use in machinery and vehicles.

It would be desirable to have a spray applicator that is able to spray both thixotropic compounds or liquids as well as Newtonian compounds, without requiring significant change in settings or applicable equipment.

It would also be desirable to have a spray applicator that is able to start or stop the spray process without producing errors, or by reducing or minimizing production of errors, in the spray pattern.

To achieve the foregoing and other objects and in accordance with the purpose of the present invention, as embodied and broadly described herein, the method and apparatus of this invention may comprise the following.

BRIEF SUMMARY OF THE INVENTION

Against the described background, it is therefore a general object of the invention to provide a spray apparatus in which the user is substantially freed from the normal requirement to shut off a materials stream when not engaged in spraying. The user receives the benefit of freeing his hands to handle other issues, which is very important in many applications.

Another object is to eliminate the commonly accepted waste factor in spray applications. This spray applicator benefits the user by lessening or substantially eliminating the need to monitor materials flow. The user is able to work without being required to shut off the flow of spray materials when finished spraying. This sprayer operates well without requiring that the user leave the target after each swath. Likewise, the spray applicator can start the spray while aimed on-target. This sprayer stays on-target and sprays error free. The typical 30% waste factor is eliminated.

A related object is to provide constant backpressure in a spray apparatus, where a material pumping or supply system overcomes the backpressure during usage to supply material to be sprayed. However, when the material pumping or supply system is paused, the backpressure terminates further feed of the material to be sprayed with no errors or at least with very few errors. The spray nozzle also is cleared so that it can again process material to be sprayed when the material pump or supply system is again triggered, with very few if any errors.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

The invention is a spray applicator assembly 10 that receives and discharges typically fluent materials from at least two sources. One fluent material is a propellant, often a propellant gas such as air, and for convenience of reference, the gaseous material may be referred to herein as being air, but without limiting the choice of gas to air. The second fluent material, which typically is a liquid-based applied or distributable product, is chosen from a wide variety of candidates. It may be liquid, it may be viscous, and may or may not contain solid particles. By way of example and not limitation, the candidates include caulk-like materials, paint, drywall topping compounds, adhesives, or any of a variety of other materials that are applied by spraying during the construction process, but not limited to these examples. This second material will be broadly referred to as a distributable product. To distinguish the typically liquid-based second fluent material from the gaseous first material, the first material will be referred to as propellant, gas, or air, and second material often will be referred to as the distributable product, although other terminology may be applied where a more specific product is to be referenced. One of the advantages achieved by spray applicator 10 is that it can apply a wide variety of distributable products without requiring a fresh calibration for each. The spray applicator 10 is capable of successfully applying a wide variety of coatings with gas pressure adjusted by a simple proportioning valve.

Figure 1:
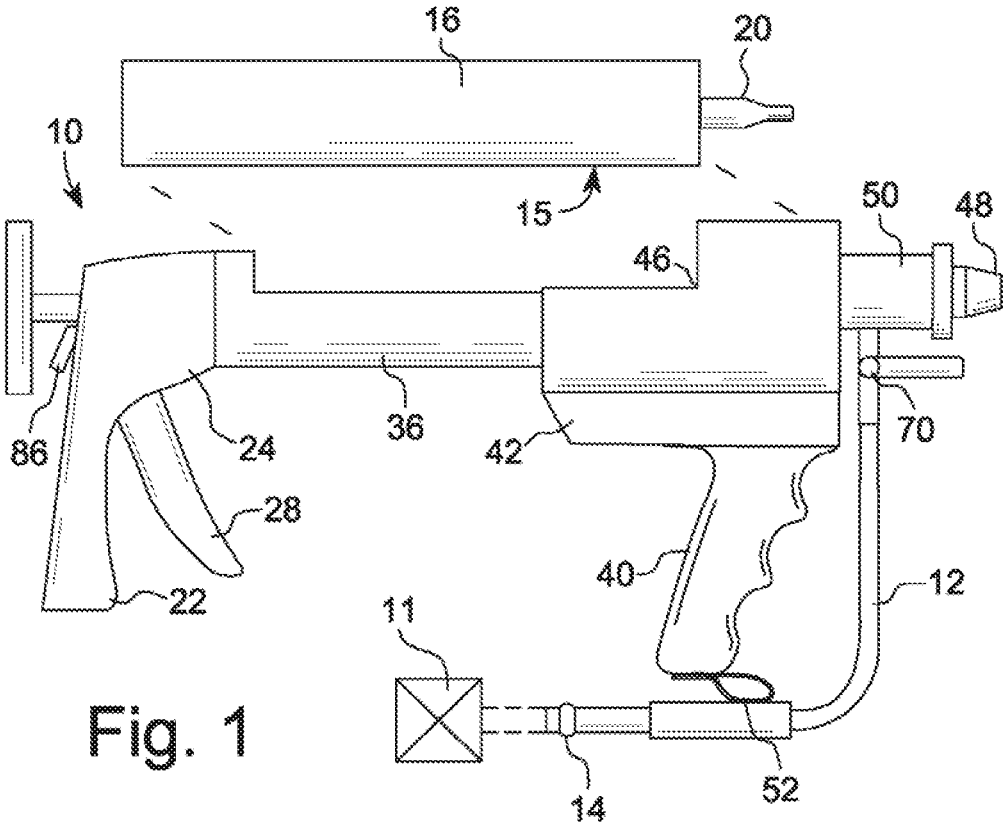
FIG. 1 is a side elevational view of the spray applicator, showing the delivery mechanism at the left, the spray nozzle at the right, and a central housing providing a front handle and coordinating the positions of the delivery mechanism and the spray nozzle.

As shown in FIG. 1, the spray applicator assembly 10 is air-assisted by a supply of propellant gas from a source such as a schematically shown compressor 11 feeding propellant gas through air supply line 12 that is configured for connection to the compressor 11 or another source of pressurized propellant gas. A quick connect tube end 14 allows ready connection to or disconnection from a source of pressurized gas. The second, fluent material to be applied is provided in a materials container 15 formed of a cylindrical cartridge body 16 containing the second, fluent material between an internal push plate 18, FIGS. 4 and 5, inside the rear of cartridge body 16, and a protruding spout 20, FIGS. 1, 3, and 9, at the front end of the cartridge body 16.

The general configuration of disclosed container 15 is similar to various commercial cartridges containing caulk or other materials that might not be suitable or desirable to be sprayed in an applicator 10. Containers 15 that are suitable for use with applicator 10 will be referred to as compatible, while any other containers will be referred to as incompatible. It would be desirable to automatically identify which containers are compatible with applicator 10 and which are incompatible. A convenient distinction can be achieved by uniquely configuring the push plate 18 of a compatible container 15. In turn, the applicator 10 can detect the different push plate of an incompatible container and act in a rejection mode to relieve pressure or harmlessly eject the contents of a detected, incompatible container.

Figure 3:
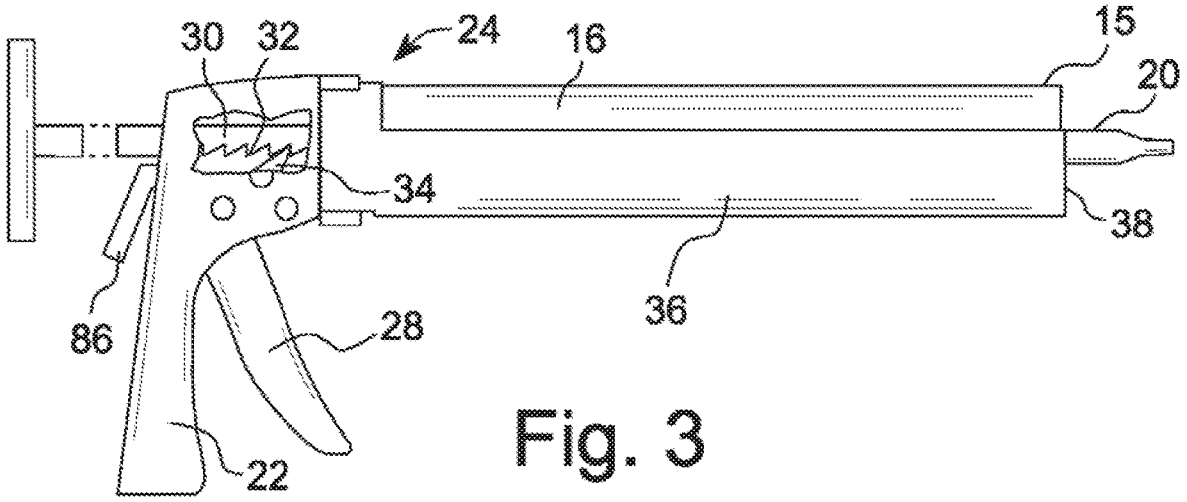
FIG. 3 is a side view of a material supply cartridge loaded in a delivery mechanism similar to a caulking gun, with a broken away surface showing a ratchet mechanism operating a toothed pushrod with advancement pawl operated by a trigger of the delivery mechanism.

The spray applicator assembly 10 has two handles for support during operation. A rear handle 22 is a combination handle that also is a portion of a delivery mechanism or materials pump 24. As best shown in FIG. 3, the rear handle 22 is a portion of a delivery mechanism 24 similar in structure and operation to the handle of a caulking gun. A trigger 28 operates an advancement mechanism to advance a pushrod 30. For positive operation, the pushrod may be configured with ratchet teeth 32, and the trigger operates a pawl 34 that engages the teeth 32 and advances the pushrod by trigger movement. A cradle 36 receives the cartridge body 16 and supports it in aligned position for the pushrod 30 to enter the rear of the cartridge body and to advance the push plate 18 therein under pressure from the pushrod. A front end wall 38 of the cradle 36 limits the forward movement of cartridge 16 so that forward movement of the pushrod will first bottom the cartridge against end wall 38 and thereafter will squeeze and eject the contents of the cartridge body through spout 20.

The spray applicator assembly 10 has a forward handle 40, FIG. 1, that is joined to or is a portion of a central housing 42. The central housing 42 receives the forward end of the delivery mechanism 24 and supports the delivery mechanism in a desired alignment, described below. The central housing 42 is configured with suitable access openings 46 to allow insertion and removal of materials cartridges 15 with respect to cradle 36. The central housing also receives and carries an output nozzle assembly 48 that includes an associated air or other gas reservoir 50. The central housing 42 establishes a spacing and alignment between the carried materials cartridge 15, the air reservoir 50, and nozzle assembly 48 as suggested in FIG. 9, where the spout 20 is shown to be aligned for axial, centerline reception into or through the air reservoir 50 of nozzle assembly 48. Thus, the forward handle 40 and central housing 42 serves as a uniting element between the materials supply and the output elements of the spray applicator assembly 10.

The central housing 42 also establishes a spacing and alignment between the delivery mechanism and the output nozzle assembly, such that when a cartridge 15 is bottomed against front end wall 38, the spout 20 is suitably advanced for sealed engagement with the output nozzle assembly, as described below.

In addition, the forward handle 40 may assist in carrying the air supply line 12. An air line carrier bracket 52 may interconnect forward handle 40 to air supply line 12. Otherwise, the air supply line 12 is connected to air reservoir 50. With two connections between the air supply line 12 and the spray applicator assembly 10, the air supply line is stable even when the user freely moves the spray applicator assembly 10.

Figure 7:
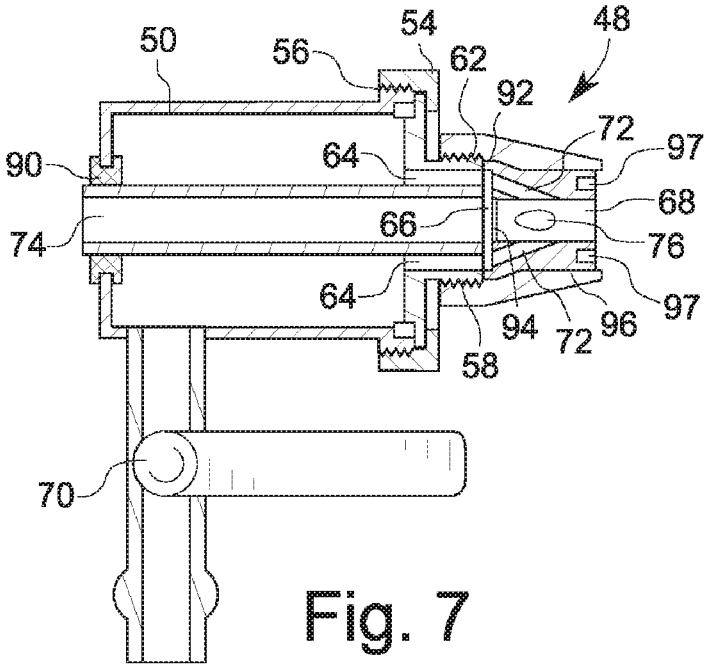
FIG. 7 is a side view in partial vertical cross section of a spray nozzle assembly.
Figure 9:
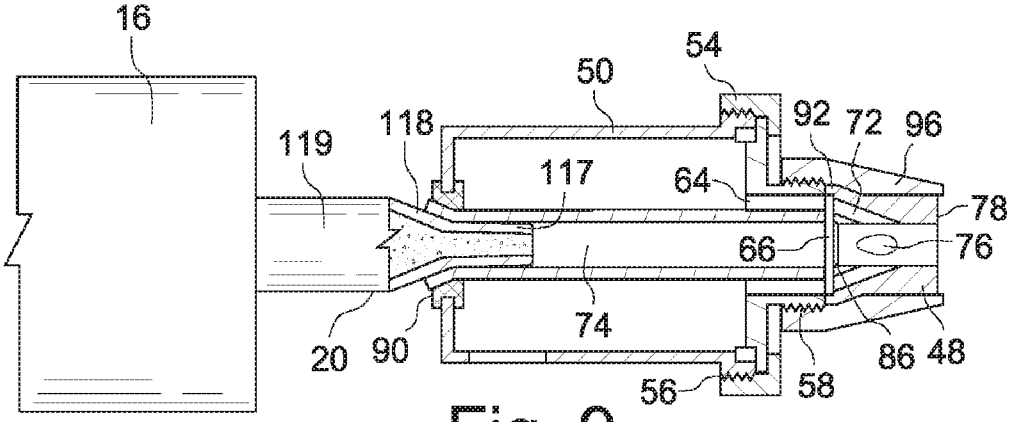
FIG. 9 is a view similar to FIG. 7, showing a material supply cartridge in partial cross section as engaged with the spray nozzle of FIG. 7.

With reference to FIGS. 7 and 9, the air reservoir 50 conveniently may be formed with a forward-end lid 54 that attaches to the body of the air reservoir 50 as a cap, attached by threads 56. The lid also defines a central, forwardly extending threaded column 58 that receives the nozzle assembly 48 on threads 62. The threaded column extends axially into nozzle assembly 48 and defines a plurality, such as four, of equally spaced, axial air passages 64 that communicate from inside air reservoir 50 into a chamber 66 located between the threaded column 58 and the nozzle assembly 48.

The nozzle assembly 48 is able to spray distributable products of widely varying viscosity, with little or no readjustment needed when changing from one sprayed material to another. This advantage follows from several factors. One factor is that the preferred nozzle assembly 48 has an open barrel bore 68 rather than a convergent-divergent type of nozzle as is common to many prior spray devices. Thus, the barrel bore may be considered to be substantially uniform. A second and related factor is that due to the use of the open barrel bore 68, the preferred nozzle assembly 48 does not require a conventional mixing chamber located behind a nozzle tip with a smaller orifice in the tip to mix the distributable products with air. Thus, according to preferred operation, the nozzle assembly 48 does not force the distributable products out such a smaller orifice with high pressure air to produce a spray. A third factor is that the preferred nozzle assembly is designed to spray the distributable product with significantly less restriction than conventionally used at a nozzle outlet.

The output nozzle assembly 48 defines a nozzle bore 68 that is substantially free of restrictions. Bore 68 has an open barrel design with a large through-bore rather than a small orifice design as commonly found in spray guns in the prior art. To produce a spray, first and second fluent materials flow through the open barrel bore 68 without being forced through a tiny, restrictive outlet orifice.

The spray applicator 10 receives pressurized air from a source 11 through line 12 and then sequentially through main air valve 70 and into the air reservoir 50. The supply of air in reservoir 50 can be at a suitable operating pressure, such as 80 to 100 psi. Relatively to some known spray equipment, this pressure might be considered to be low or moderate. This air is converted into a high velocity stream by travel through relatively narrow passages 64. As a non-limiting example, the reservoir 50 might be cylindrical with two inch diameter and three inch height. The narrow passages 64 might have 3⁄32 inch diameter, which demonstrates by comparison that the passages are narrower than the reservoir by more than an order of magnitude, which can be expected to result in gas flow through the passages 64 being at a high velocity. The gas flow through passages 64 might continue through passages 72 in a high velocity air stream, leading into a multi-inlet blast chamber within the barrel bore 68 of the nozzle tip that breaks up the distributable product into a spray. Then, the distributable product is pushed out the tip of bore 68 with no restrictions in the end of the tip. As an example, the multi-inlet blast chamber may be fed air from the four inlet passages 64 in lid 54, where air velocity increases. The distributable product is forced out the tip 68 by the four high velocity air streams generated in the nozzle assembly 48. Four evenly distributed passages 72 are located forward of reservoir 50 and receive pressurized air from passages 64 in the reservoir lid, producing further high velocity air streams. The four passages 72 are centrally angled to receive some of the output of passages 64 and to direct it through ports 76 into the open barrel contour of the nozzle bore 68 to break up the distributable products into droplets. The function of the angled shafts inside the tip can be different with regard to weather the tip has second materials in it or not. The distributable product is fed into the barrel 68 of the nozzle tip 78 by the axial material transfer tube 74. As a result, the droplets of distributable product become a uniform high velocity spray that leaves the output nozzle 48 without errors, even while spraying heavy thixotropic compounds.

Thixotropy is a time-dependent shear thinning property. Certain gels or fluids that are thick or viscous under static conditions will flow by becoming thin and less viscous over time when shaken, agitated, or otherwise stressed, in what is termed time dependent viscosity. They then take a fixed time to return to a more viscous state. These heavy viscosity, non-Newtonian vinyl compounds, will usually create errors in the spray for sprayers operating with convergent-divergent prior art nozzle technology.

The spray output nozzle 48 requires a connected materials cartridge 15 to complete the nozzle assembly 48 by the insertion of a tapered hard plastic spout 20 of the materials cartridge. The inserted spout 20 establishes a temporary water tight seal that seals with the air system in the nozzle and facilitates the feed of distributable product to the output nozzle 48 from the cartridge 16.

The spray applicator 10 is useful wherever a sprayer is needed, especially where the user benefits from not having to monitor the materials flow and be required to shut off the materials flow when finished spraying. The physical requirement of a user having to shut off a materials stream and the benefit of freeing the user's hands for other issues is very important in many applications. Additionally, current spray technologies require a user to redirect the spray off the target surface before shutting down materials flow after each swath of spray. This practice wastes approximately 30% of the materials. In contrast, spray applicator 10 is capable of terminating spray at the end of a swath, without errors. Consequently, spray applicator 10 need not leave the target after each swath; nor does spray applicator 10 need to start the spray off-target for each new swath. Spray applicator 10 can stay on-target and spray error free. The former waste factor of 30% is vastly improved upon.

Figure 10:
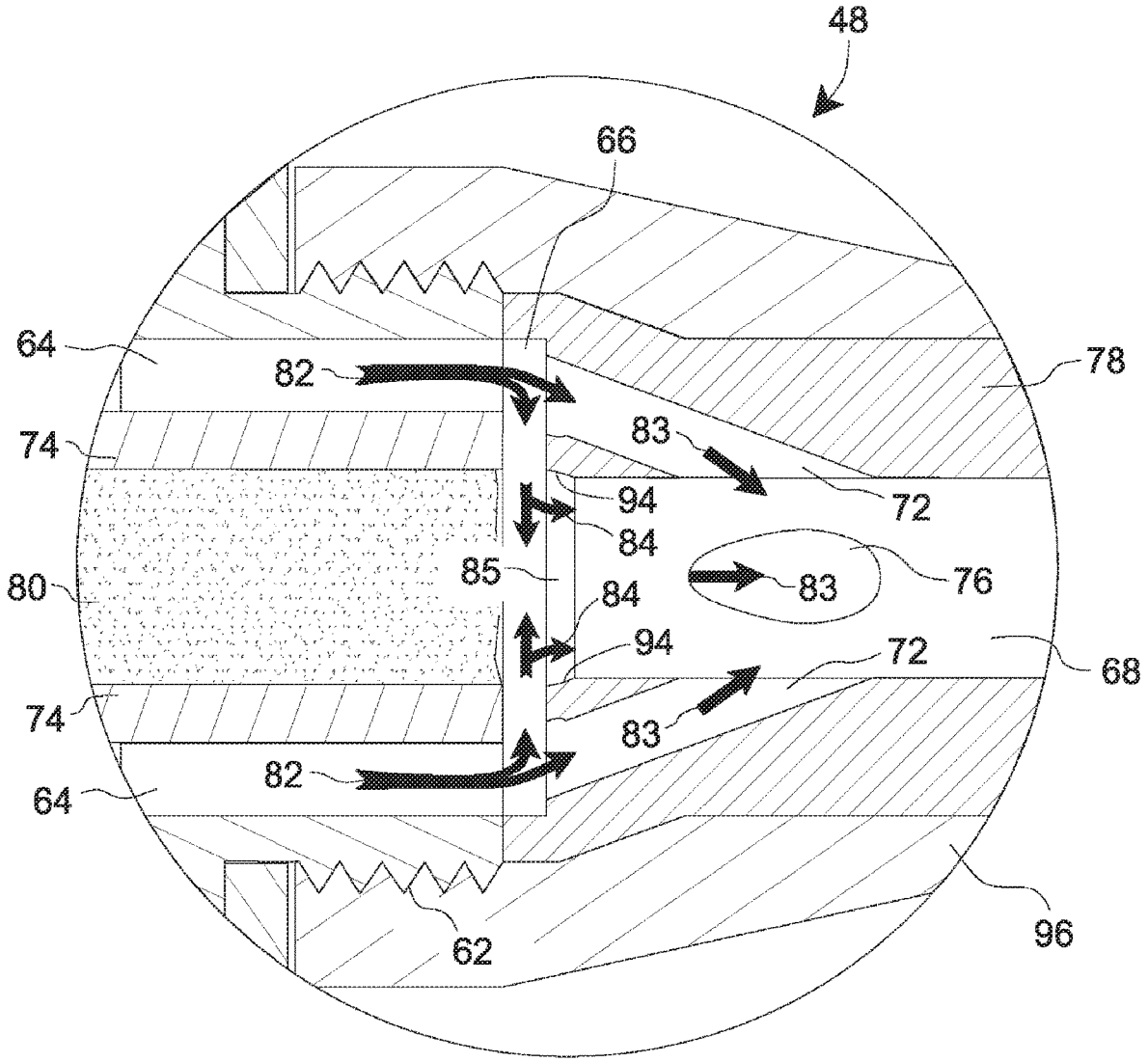
FIG. 10 is an enlarged detail view of the output nozzle assembly of FIGS. 7 and 9, showing airflow supplying constant backpressure and clearing the nozzle during non-use.

The forward flow of distributable products often is pressurized by a hand pump or an electric pump. The forward pressure can be regarded as a known quantity because the sufficiency of hand operation or electric pump operation is well established. The nozzle assembly 48 automatically shuts off the forward flow of the distributable products to the nozzle barrel 68 when the pumped forward movement of the distributable products is stopped or paused. This ability results in a shutoff from spraying that is error free. When the flow of distributable products resumes, such as when the user again pumps the materials pump 24, the nozzle 68 automatically resumes the same spray without error. This performance ability is best understood by reference to FIG. 10. A supply of distributable product 80 is pumped forward from the materials cartridge into the material transfer tube 74 under an established forward pressure. At the same time, pressurized airflow from reservoir 50 advances through air passages 64, with this portion of airflow represented by arrows 82. Both the advancing distributable product 80 and the pressurized airflow 82 reach primary air chamber 66. Depending upon dynamic factors, airflow 82 can advance through angled air passages 72 and outlet ports 76 in the nozzle bore, and/or airflow 82 can advance centrally in chamber 66 toward the advancing stream of distributable product 80.

Where the pump 24 is pushing the distributable product 80, the distributable product 80 will advance through chamber 66 and into nozzle bore 68. In this situation, the airflow 82 will not prevent the distributable products from traversing chamber 66. Rather, substantially the entire airflow 82 will advance into the forward passages 72, where the airflow is indicated by airflow arrows 83. The four jets 83 transmit a high speed air stream generated by the four high speed air inlets 64 in the primary air chamber 66. Under certain operational conditions, the air stream 83 may be a supersonic sound wave stream. The wave stream is transmitted into the distributable products received in bore 68 as the distributable products pass ports 76 in the barrel. The pre-spray material flow has secondary contact with the high speed, possibly supersonic air stream when it passes the four ports 76 in the barrel. The spray is now set at correct speed and density and leaves the barrel at a high speed that in hypothetical example may be approximately 790 feet per second. This hypothetical speed is below supersonic but fast enough to stay stable in air. The converging outputs from ports 76 will operate as further described, below, to spray the distributable product 80 from the nozzle.

When the pump 24 is not actively pushing the distributable product 80, the airflow 82 will be partially directed centrally in chamber 66. A portion of airflow 82, represented by subsequent airflow arrows 84, will cut off the supply of distributable product 80 roughly at air chamber 66. This subsequent airflow 84, in conjunction with airflow from passages 72, cleans the nozzle bore 68 of distributable product 80 sufficiently to significantly reduce or eliminate errors in the spray. When pumping of distributable product 80 resumes, the nozzle starts cleanly.

Typically, air enters the reservoir 50 at approximately 80 to 100 lbs from a compressor via air tube 12. This is relatively low pressure and, thus, the spray applicator 10 can use inexpensive compressors. In addition, spray applicator 10 is able to spray many viscosities from the same nozzle assembly 48, error free. In prior practice, it is often necessary to use high end air compressors with high pressure air supplies to be able to spray high viscosity materials. The spray applicator 10 doesn't require a user to switch out the nozzle or the compressor to be able to spray paint and then spray a high viscosity material. The same nozzle and compressor can spray both compounds, error free. This advantage doesn't exist in prior art spray technology.

The spray applicator assembly 10 has a main air flow valve 70 that regulates the air flow to the assembly 10. As an example, valve 70 may have a simple rotatable passage design. After incoming air passes through the main air valve 70, it enters the main air reservoir 50 where the air is stored in high volume, being replenished continually by the air from a pressure source such as an air tank or air compressor feeding through air line 12. A suitable pressure source may be any sort of determined or undetermined means or device that provides air at adequate pressure and volume. For convenience of description, the pressure source may be referred to as a compressor, but without limitation to that particular type of pressure source. The air line 12, itself, may be regarded as being the pressure source. This volume of air in reservoir 50 acts as a buffer, a compensator, and a shock absorber that stops backpressure surges. Reservoir 50 functions as an air storage chamber. The air initially enters this chamber from the compressor or other source and is critical to establishing an even feed of the air into the four shafts 64. The nozzle 78 shifts from performing a material spray function to performing as an automatic materials flow control device. The nozzle assembly 48 relies on the air storage chamber 50 to absorb the changes in air flow demands, which are different in each mode. Reservoir 50 acts as a shock absorber for the air flow demands of each type of distributable products or no materials in the nozzle. Reservoir 50 allows the nozzle assembly 48 to draw air in case of momentary shortage and to store air in case of momentary excess. The reservoir buffers the air flow so that the nozzle assembly 48 will expel unused air from tip 68. The air reservoir 50 keeps the nozzle operating smoothly and error free.

When the nozzle assembly 48 is not processing distributable products in the barrel 68 of the tip, automatically the air reroutes and causes a backpressure surge. The air reservoir 50 effectively absorbs the backpressure serge to stop siphoning of the distributable products during a reset of materials pump 24. The air of the backpressure surge holds back the flow of distributable products, automatically. For example, as soon as the user stops pumping the distributable products into the nozzle, the air re-routes within the nozzle and controls the flow of distributable product to stop it from entering the nozzle bore 68. This instantaneous and automatic stoppage of distributable products flow distinguishes the spray applicator 10 from other known spray nozzle technologies. The use of an air reservoir 50 within the nozzle assembly 48 to start and stop the spray function without error is unique.

Switching from spraying a Newtonian compound to spraying a high viscosity non-Newtonian compound such as a vinyl compound or drywall texture compounds can present significant problems with currently conventional spray technology. With some current spray technologies, this sort of change may require the user to change the nozzle or even the entire sprayer and possibly change the air compressor, as well. By comparison, the applicator assembly 10 is capable of switching from a high viscosity, non-Newtonian compound to a thixotropic compound or to a liquid compound such as a paint or adhesive compound. The nozzle assembly 48 of the spray applicator assembly 10 may require the user to reset the main air valve 70 on the tool according to the type of materials to be sprayed, but with no change of compressor or no change to another variation of the spray applicator assembly 10. The spray applicator assembly 10 is capable of spraying many viscosities of distributable products while using a single spray applicator assembly. In addition, the spray applicator assembly 10 requires only low volume air compressors, which are not expensive to buy.

Many currently supplied sprayers use choked flow fluid dynamics to produce supersonic velocities for creating a spray. In such conventional sprayers, the sprayed materials are shot from an orifice of the tip at supersonic speeds by the force of high powered air streams. The size of the nozzle orifice relates to the speed of the air, the materials mixture, and the spray size. These conventional spray systems need high powered air compressors to be able to spray heavy materials. This is an expensive endeavor. Both the high powered compressors and the material pumps are expensive. In addition to the expense, such known systems can encounter difficulty when the sprayer has to share the compressor with the materials pump. The problem is exacerbated if the pump also is trying to pump a heavy compound, because the pump can rob the air power from the spray nozzle. For example, it is well known that nozzles have extreme problems being able to spray heavy vinyl compounds.

Thixotropic compounds typically are resistant to flow through a hose. Standard spray methods often cannot spray them, because most sprayers require the distributable products to be delivered by a hose to the spray system. In contrast, the spray applicator assembly 10 utilizes a cartridge system for delivering distributable products, resulting in very short material transfer distances from the cartridge 15 to the nozzle assembly 48. The cartridge system is closely similar to achieving materials delivery of thixotropic material compounds to the nozzle without a hose. Thixotropic materials are resistant to flow and sag, and thus they are very hard to spray. There are no typical, lengthy delivery hoses in the spray applicator assembly 10. As contrasted to standard spray technology, in the spray applicator assembly 10 thixotropic materials are not forced into a pump attached to a lengthy hose and then attached to a spray gun. Thixotropic materials in the spray applicator assembly 10 do not clog hoses and are not compressed into a hose. Compression is known to damage some compounds and tends to damage the integrity of the compound before it is sprayed. Nozzle assembly 48 does not damage the integrity of such materials.

The spray applicator assembly 10 combines the function of a materials pump with a nozzle assembly. This combination has the advantage of eliminating the need to maintain long hoses and fittings. Commonly in prior art, feed lines for distributable product requires high maintenance, such as cleaning a fifty foot hose and disassembling several valves. This high degree of maintenance can easily result in the need to replace hoses and valves on a frequent basis, such as every month. An air feed system on a spray system using a conventional mixing chamber can require similar high maintenance and frequent replacement.

Figure 6:
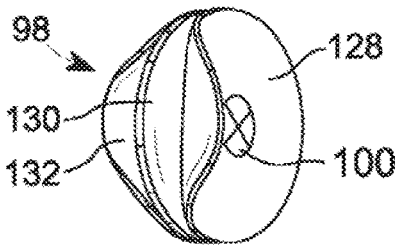
FIG. 6 is an isometric view taken from right side and front of the pad that will be placed on the face of the cartridge push plate of FIG. 5.
Figure 8:
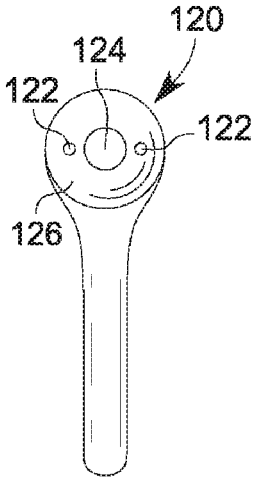
FIG. 8 is a front view of a spanner wrench adapted for turning the nozzle tip.

In the spray applicator assembly 10, the output nozzle assembly 48 handles thixotropic materials in a new way. These materials are prepared for spraying in the open barrel nozzle 68. Air from reservoir 50, typically at source or compressor pressure of 80 to 100 psi, is routed into four evenly spaced air passages 64, which in accordance with FIGS. 6-8 are axially directed and formed in a forward lid 54 of the air reservoir 50. Each of the passages 64 is about 3/32 inch diameter and about an inch in length. These passages function as Venturi tubes that increase the velocity of the transmitted air according to the Bernoulli principle. The air streams from passages 64 then enter the converging passages 72 and enter the nozzle bore 68 at high speed, at locations about 2/3 of the distance behind the outlet tip. Four jets of air from angled passages 72 advance through four large oval shaped ports 76 that are located in the barrel of the nozzle bore. The nozzle bore functions as a blasting chamber within the tip. Notably, functioning as a blasting chamber differs from functioning as a mixing chamber. The operation of a blasting chamber doesn't mix the distributable products with the compressed air, as occurs when typical nozzles force the mixture out of a mixing chamber and through a tiny orifice.

The four high velocity air jets coming from the tubes 64 in the threaded column 58 enter the nozzle assembly evenly and in an equally spaced pattern in the circumference of the threaded column 58. The primary air chamber 66 is defined between threaded column 58 and the nozzle assembly 48 and, as a hypothetical and non-limiting example, may be about 3/32nds inch deep. This space is a secondary air reservoir. The air from passages 64 enters the primary air chamber 66 and from there enters the four secondary, angled tubes or Venturi passages 72. As a further hypothetical and non-limiting example, the angled Venturi passages 72 are arranged at an angle of 26 to 28 degrees relative to the longitudinal axis or centerline of the nozzle bore 68. The four secondary Venturi passages create high pressure jets in the nozzle tip. The secondary Venturi jets also channel the high velocity air flow at an angle in the nozzle bore 68. Each of the four elongated, oval ports 76 enters the barrel in a position approximately opposite to another of the ports. The four elongated air ports take up approximately 75% of the barrel circumference. This creates a blasting chamber driven by high velocity air streams from these ports 76 and on the radii of the barrel bore.

The accelerated air streams entering bore 68 hit the distributable products passing through the turbulence of these air streams. The distributable products are broken down into droplets. Then the high volume, high velocity air stream escapes from the barrel bore and forces the droplets of distributable products out of the barrel bore 68 at speeds that achieve a spray. The droplets of distributable products are blown out of the barrel bore 68 by air at a high velocity, created by the nozzle assembly. Unlike typical spray operations, the droplets are not forced through a restricted tip orifice from a mixing chamber located behind the restricted tip orifice to achieve a spray.

Standard spray technology often places a mixing chamber in-line with a spray orifice and directly behind the spray orifice. In nozzle 78, a limited mixing takes place when air from passages 64 and 72 meets distributable products in open bore 68. However, the method practiced in nozzle 78 differs from other techniques because the air stream does not force the distributable products through an orifice in the nozzle. Where the term "nozzle" has been used in certain examples from the prior art, the presence of a taper or constriction optionally might be implied. Such implication is not applicable to the present nozzle 78. This difference is evident from analysis of the sprayed material after it hits the sprayed surface, where it is evident that the sprayed materials are not loaded with tiny bubbles, as often seen in typical spray applications.

A further distinction from standard spray technology is that spray apparatus 10 produces a flat, even spray pattern, where standard sprays create a center loaded pattern. Typically in prior art, when a spray system forces the material to be applied to thoroughly mix with the air, the air pushes the materials out a tiny orifice to establish a spray. The consequence is a center-loaded effect called a "bull's eye." The user typically tries to hide the bull's eye effect by indiscriminately moving or waving the sprayer to hide this effect. In contrast, the spray apparatus 10 produces a far flatter spray, allowing a user to spray each single swath with a substantially even coat.

Attempts to spray thixotropic material using a conventional mixing chamber and with conventional spray equipment are subject to special limitations. Two prerequisites are needed to achieve successful spray. The first prerequisite is that the thixotropic material must enter the standard mixing chamber. Typically the first prerequisite is met by pumping the thixotropic material into the mixing chamber. The second prerequisite is that the material to be applied that reaches the standard mixing chamber must flow into the path of the air stream. With thixotropic material, the second prerequisite is the problem. The air stream in a conventional mixing chamber can blow a hole through the thixotropic material, but under these conditions such materials lack flow and will not flow into the path of the air stream. A standard mixing chamber and a tip assembly will not reliably spray thixotropic or thick flow resistant materials very well, without errors.

With spray applicator 10, thixotropic materials are transferred a very short distance, such as only two inches of inline movement without restricting the thixotropic material. Movement over this minimal travel distance conquers the fact that thixotropic materials are resistant to being pumped long distances to a nozzle and thus cannot be sprayed very easily with conventional equipment. In spray applicator 10, the nozzle bore 68 does not store materials to be sprayed. Thixotropic materials enter an unobstructed barrel 68, which is open to the degree that it has no restrictive tip connected to the barrel. Thus, barrel 68 my resemble a conventional mixing chamber because spray materials meet the air in the barrel, although conventional mixing of air with spray materials is absent.

From nozzle bore 68, spray droplets are forced out the front-end of the nozzle bore 68 primary by high velocity air flow that is present in the primary air chamber 66. The air mass builds in the primary air chamber 66 accordingly, with respect to the usage factor of the tip, such as by whether the tip is processing distributable product or is at rest with no distributable products being processed in the tip bore. This unique function is enabled by the airflow from the main air storage chamber in reservoir 50. The reservoir 50 increases its air and regulates the air flow within the nozzle to allow the proper airflow for each function the nozzle requires, automatically. Without this reservoir 50, the nozzle assembly will be starved of air when spraying and have spurts of air from when the nozzle is at rest with no distributable products in the nozzle. The reservoir chamber acts as a compensator with regard to airflow control in the nozzle. This is a reason why the air reservoir 50 is attached to the nozzle assembly as a part of the nozzle.

The nozzle assembly 48 uses the Laval theory of choked flow with respect to airflow only. The distributable products and air are not mixed, in contrast to the common practice when a convergent-divergent restriction with small orifice is present. The latter reflects the conventional occurrence when air forces a mixture of a distributable products and air through a small orifice to produce spray. The Venturi effect is only applicable in the nozzle assembly 48 of the spray applicator assembly 10 in the air system and not with respect to the creation of the spray.

The air system of the spray applicator assembly 10 creates the basis to apply the Bernoulli principle to describe the performance of the nozzle 68. The conservation of mass principle requires the air velocity to increase as the air flows through the smaller pipes 64 into the primary air chamber 66 from the air reservoir 50. At the same time, the Venturi effect causes the static pressure, and the density of the air stream, to decrease downstream, beyond the restriction. However, the velocity of the air stream is substantially increased before it enters the nozzle bore 68. Thus the higher velocity air is injected into the nozzle tip by the four Venturi tubes 72, which enables the nozzle to blast the higher viscosity materials into droplets without needing to employ an expensive compressor to provide air with very high cfm and psi characteristics.

Spray applicator assembly 10 employs a drive system in the materials pump 24 that is similar to a modern caulking drive system. This drive system requires that the pushrod 30 not relieve itself in forward movement as takes place with modern anti-drip caulking gun drives. The drive system of materials pump 24 stays stationary in forward movement between pump strokes. Modern caulking guns are dripless and relieve the forward pressure that the pushrod and piston exert on the push plate in the caulking tube. The materials pump 24 is a stationary hold type mechanism and does not relieve the pressure developed from prior pumping of distributable products. At the end of a pumping session, materials pump 24 holds the pushrod and piston in the same position as when pumping session ended. The pushrod is not able to reverse itself and relieve pressure after each stroke.

The pushrod in the sprayer also is not allowed to be forced backward when the operator is adjusting the air. The sprayer is equipped with a lock-drive ratchet system that has a much tighter grip on the pushrod so as not to allow the pushrod to be forced back from the air pressure in the tool.

To load a new materials cartridge into the spray assembly 10, the user pulls back the pushrod 30 by releasing a latch lock 86 on the rear of the pushrod. The release mechanism of the latch lock 86 disengages the ratchet teeth and allows the user to pull back the pushrod 30, together with the piston 88 on the front of the pushrod. When the pushrod is sufficiently out of the old cartridge body 16, the user removes the old materials cartridge 15 from the cradle 36. Then the user trims the forward end of the new, sealed, tapered plastic spout 20 with a cutting knife, removing about ½ inch to expose the distributable products in the spout. The user places the new materials cartridge 15 in the cradle 36 of the spray tool 10 and pumps once on the pump trigger 28, pushing the new cartridge forward until restrained by the front end wall 38 of the cradle. End wall 38 establishes the maximum forward position of the cartridge, where the tip of the new plastic spout is adequately pushed into the back end of the plastic materials transfer tube 74 in the body of the spray applicator 10. The forward motion of the new cartridge establishes a temporary, water tight connection between the new spout 20 and the rear end of the material transfer tube 74. A elastic ring such as a rubber grommet 90 seals the material transfer tube to the tube port in the back wall of the air reservoir 50 and aids in forming the seal between the material transfer tube 74 and the spout 20. When spout 20 enters the rear end of the materials transfer tube 74, the grommet 90 comprises a compression ring around the end of the tube 74. The spray applicator 10 maintains the forward motion and the temporary water tight connection, completing an air lock so that the spray applicator assembly has sources of both air and distributable product. The user then adjusts airflow at valve 70 to a point where he feels the pushrod shift its load due to backpressure, which indicates a correct setting for proper airflow. The user then is ready to spray the new cartridge of distributable product.

As best seen in FIG. 9, the preferred contour of the spout 20 is to have a nose 117, where the nose 117 has a convenient original length such as 1.5 inches. To open the cartridge for use, the user can trim off a portion of the nose, such as approximately one-half inch from the new cartridge nose 20, leaving a sufficient residual nose length to engage in the tube 74 of the nozzle. Nose 117 has a forward taper with a diameter that is smaller than the entrance into the material transfer tube 74 of the nozzle assembly 48. Behind nose 117, the spout forms a backward flare 118 at an angle of approximately 47 degrees to center line of spout 20, which is a suitable angle to engage in tube 74 and spread the receiving end of tube 74 to create a temporary water tight seal with tube 74. Nose 117 and flare 118 also create a seal with o-ring or grommet 90, which is positioned between the tube 74 and the edge of the tube port in the back wall of the air reservoir 50. The proper relative positioning and sealing between cartridge 15 in cradle 36 and nozzle 48 is ensured by central housing 42, which receives the cradle and nozzle in predetermined relative positions that establish the desired seal.

Behind flare 118, the spout 20 forms a tube-connecting portion 119 that communicates with the interior of cartridge body 16 to deliver carried material to the forward portions of the spout. A suitable diameter for connecting portion 119 is ⅝ inch. The tube spout 20 is made of hard plastic material so as not to be crushed while establishing the connection with the materials transfer tube 74 and grommet 90. Thus, spout 20 must be hard and strong enough that it can be pushed forward into place and pumped. The spout must expand the plastic material transfer tube and expand the rubber o-ring or grommet 90 in the back of the air chamber. The junction between the cradle 36 and the nozzle assembly 48 is coordinated with the size and proportions of the materials cartridge 15. In greater detail, the position of the front wall 38 of cradle 36 is coordinated with the position of the rear end of tube 74, so that the cartridge spout will seal with the material transfer tube 74. Thus, the cartridge 15 is coordinated in size to properly perform in the spray applicator assembly 10.

The main airflow valve 70 of the nozzle assembly 48 is where pressurized air enters the assembly. Valve 70 is sufficient to serve as the only air adjustment in the spray assembly 10. The air from a compressor enters the spray nozzle assembly 48 at air reservoir 50, where the air is stored at high volume and is continuously replenished by the air from the compressor. This volume of air in reservoir 50 is both a buffer and a reservoir. This volume of air also is a compensator and shock absorber that allows the nozzle assembly 48 to have adequate air for operations. When air is not being used, the air in reservoir 50 buffers airflow so that the nozzle 48 will expel the unused air out the nozzle tip piece 78. The shock absorber aspect of the air volume in reservoir 50 is to stop backpressure surges. The operation of the reservoir 50 keeps the nozzle assembly 48 running smoothly and error free when the nozzle is not processing the material to be sprayed in the open barrel tip 68. The air reroutes automatically and causes backpressure surges, which the air reservoir absorbs very effectively.

According to a non-limiting example of the spray applicator 10, revealing details of preferred dimensions and operating parameters, the nozzle tip 68 receives four high velocity air flows that originate from the air passages 64 and feed into the nozzle assembly 48 at primary air chamber 66. From the primary air chamber 66, the pressurized air is routed forward in the nozzle assembly 48 through four secondary Venturi tubes 72 in the nozzle tip 78. The air is again accelerated in the passages 72. Then, the air in the tubes 72 exits these tubes and enters the open barrel bore 68 approximately ⅔rds of the distance behind nozzle outlet. Tubes 72 enter the open barrel bore 68 from four elongated oval ports 76 that are spaced evenly in the radii of the barrel and converge toward the same point within the barrel 68.

According to a further aspect of this non-limiting example, the tip piece 78, FIG. 9, of the nozzle assembly 48 is formed of one piece with about ¾ inch in axial length and ⅝ inch in diameter at the rearward end. A 3/32 inch depression is formed into the rearward end of the tip, forming primary air chamber 66. A circumferential 1/16 inch lip 92 surrounds the primary air chamber 66 at the outside edge. The open barrel bore 68 of the tip of the bore is about 134 thousandths inch diameter, which makes it just over a ⅛ inch bore. It is drilled along the axial centerline of the tip and extends entirely through the tip. The axially rearward end 94 of the barrel bore 68 has a 3/32 inch bevel, best seen in FIGS. 10 and 11. Each of the four angled holes 72 has approximately a 1/16th inch radius and is formed in the forward wall of the primary air chamber 66. The angled holes 72 are drilled in the tip piece 78 at an approximate angle of 26-28 degrees and extend from the forward wall of the primary air chamber 66 to a point in the open barrel 68, approximately ⅔rds up the barrel 68. The barrel bore 68 is approximately ½ inch long and 0.067 inches wide in radius. The bore hole in the nozzle is substantially uniform at least forward from outlet ports 76. A tapered collet 96 is contoured to fit around the circumference of the tip piece 78 and engages threads 62 to tighten against the tip piece to hold the tip piece 78 in fixed position on the nozzle assembly 48. When slightly loosened, the collet allows the tip piece 78 to be rotated as may be desired, such as to adjust the alignment of passages 72 with respect to passages 64, which can alter air flow between passages 64 and 72.

Continuing with the non-limiting example, to aid in rotating the tip piece 78, the tip piece may be configured to rotate in cooperation with a wrench 120, FIG. 8. For example, the front surface of the tip piece may be configured with shallow holes 97 positioned to receive mating pins 122 of a spanner wrench 120 to assist in rotating the tip piece 78. One method of adjusting the rotational position of the tip piece 78 is to loosen the collet 96 so that the tip piece can be rotated. Using a wrench that has a center hole 124 the same size as the barrel outlet, the tip piece 78 can be rotated while the spray applicator 10 is in operation, spraying through the center hole 124 in the wrench. With the spray applicator 10 in dynamic operation, the spray can be evaluated according to varied characteristics of air flow between passages 64 and 72 and empirically adjusted to the user's preference. The wrench can hold the tip piece in the desired orientation while tightening the collet 96. The face plate 126 of the wrench is sized to overlap the leading edge of the collet 96 so that the collet cannot be over loosened during the adjustment. FIGS. 7 and 9 show the collet 96 extending further forward than the nozzle tip 78. A forward extension of about 1/16 inch when the collet is tight is acceptable. As the collet is loosened on threads 62, the collet increases its forward extension. A sufficient forward extension of the collet will push the wrench to disengage the pins 122 from the holes 97. Over loosening the collet might otherwise result in pressure leaks around the tip piece during adjustment, which might result in an inaccurate adjustment. Thus, the length of pins 122, the depth of holes 97, and the relative forward extension of the collet with respect to the tip piece at various degrees of tightening are variable factors in determining how loose the collect can be made when adjusting the rotational position of the tip piece 78.

This method of setting the tip piece 78 is especially useful when using the same nozzle, first, to spray a low viscosity liquid and, second, to spray a high viscosity material. For the former, a heavier backpressure in the tip is useful to control liquids from moving into the nozzle during reset of the material pump handle 28. The nozzle should have the sets of ports 72 in the tip piece 78 and ports 64 in the threaded column 58 out of alignment, thereby establishing heavier backpressure in the tip piece 78. For the latter, when spraying higher viscosity materials, the ports can be set straight across from each other so as to rout more air to the function of processing distributable products and less air to controlling flow.

The method of adjusting the nozzle can begin with the tip secured by the collet on the threaded column 58, with the holes 64 and 72 aligned. Next, the collet is slightly loosened on the threads 62. The pins 122 of spanner wrench 120 are engaged in holes 97 on the front of the nozzle. Turning the wrench adjusts the relationship between the holes 64 and 72. Positioning the holes out of alignment results in higher backpressure within the primary air chamber 66, which is beneficial for controlling liquids. When the second material is liquid, higher air pressure in the rear of the nozzle is desirable to stop the liquid from escaping past the primary air chamber and causing errors while the user is resting the spray apparatus. Positioning the holes in alignment increases air in the forward part of the tip, which better breaks up thick materials. When the desired adjustment is reached, the user can pause spray apparatus 10, remove the spanner wrench from the nozzle tip, retighten the collet, and then resume spraying.

In the nozzle assembly 48, air is vectored through the several tubes 72 in a forward converging pattern that meets in the barrel 68. The forward openings 76 of the converging tubes 72 are located near the rearward end of the open barrel 68. The angle directs the air streams to meet in the center of the barrel, where the air streams meet near the centerline of the open barrel. The axial material transfer tube 74 receives distributable products from the materials pump 24. Tube 74 extends from the rear of the nozzle assembly 48 to the primary air chamber 66, where the distributable product meets the high pressure air from the primary air chamber 66. The high pressure serves as a backpressure applied to the distributable products immediately before the distributable products enter the open bore 68. This backpressure is in the tip piece 78 throughout operation of the spray applicator assembly 10. Thus, the distributable products are forced past the primary air chamber 66 during the pumping of the material delivery pump 24, which forces the distributable products forward into the open bore nozzle 68. While the material delivery pump 24 is resetting between successive pumps, the air from the primary air chamber 66 automatically holds the distributable products at check until the user forces the next pump of materials through the tip.

Thus the user can stop pumping materials at any moment or at the end of each pump cycle to reset the trigger 28 without the sprayer sucking and siphoning the distributable products through the nozzle, as otherwise tends to be standard technology. This nozzle assembly 48 automatically shuts off all the materials flow when the user is not pumping the materials pump 24. The nozzle 68 blows clean air with no errors or spitting as happens in a conventional sprayer when materials flow is shut off. Thus, with spray applicator assembly 10, no errors happen when the user stops and starts the spray while the sprayer is still aimed on the target. Stopping and starting spraying while on-target does not cause errors in the spray.

Figure 4:
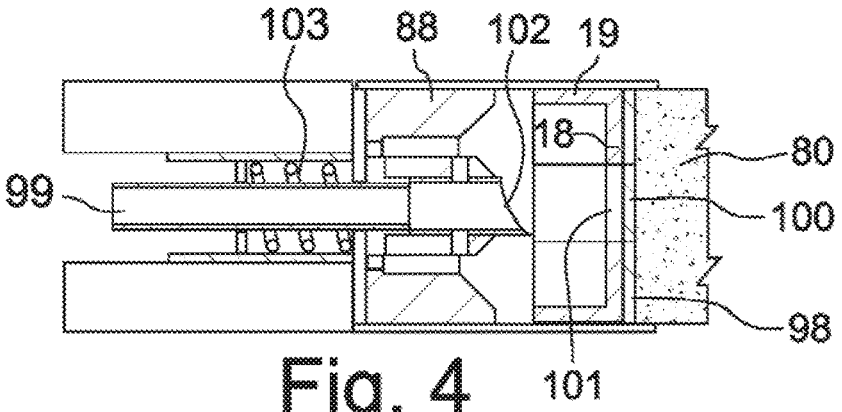
FIG. 4 is a side view in vertical cross section of a pushrod and pushing piston carrying a relief head such as a cutter head or heater head, located in the delivery mechanism of FIG. 3, and also showing a coordinated cartridge piston in a material supply cartridge, configured to deliver contents of the material supply cartridge without being damaged by the relief head.
Figure 5:
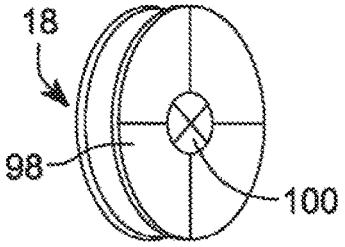
FIG. 5 is an isometric view taken from right side and front position, showing details of the cartridge push plate and of a blow-out relief feature of the cartridge push plate.

A materials container 15 contains a charge of distributable product in the cartridge body 16. With reference to FIGS. 4 and 5, the advancing piston 88 on the pushrod 30 will advance an internal push plate 18 in the cartridge body 16. In turn, the push plate 18 ejects the charge of distributable product through the spout 20 as the internal push plate 18 is advanced. As a safety factor, the internal push plate 18 is configured to allow the backwards release of the cartridge contents, to prevent other types of failure or blowout in case overly high air pressure is applied to the spray applicator 10. For example, overly high pressure otherwise might cause rupture of the cartridge body 16. As best shown in FIGS. 5 and 6, a multi-layer sealing pad 98 is attached, such as by adhesive or heat, to the forward face of the push plate 18. A suggested structure for pad 98 is a forward layer 128 of water resistant plastic film, a center layer 130 of aluminum foil or plastic film, and a rearward layer 132 of sealable polyfilm. The polyfilm layer 132 of the seal is a plastic material that can be glued to the push plate 18 and is compatible with permanent glues on the seal. The interior layer 130 of the seal composition is metal foil or thin plastic film. The outer layer 128 is another film designed to blow out at a certain air pressure, such as 140 psi, that is well above the suggested operating pressures of 80 to 100 psi. The pad 98 may have a designated central break-away portion 100. The forward face of the cartridge push plate 18 is configured with a central opening or break-away panel 101 behind the pad portion 100. If too much backpressure is applied to the contents 80 of the cartridge 15, for example by over pressure in primary air chamber 66, breakaway pad portion 100 and breakaway push plate portion 101, where used, open to provide a relief passage to the rear of the push plate 18, allowing the contents of the cartridge 15 to drain to the rear in a controlled manner instead of rupturing the cartridge in another way.

As a further safety measure, the pushrod 30 is configured to relieve the contents 80 of incompatible containers by an interaction with the push plate 18 of each container loaded into the spray applicator assembly 10. A preferred structure for a push plate defeating device is shown in FIG. 4, where the pushrod carries a piston 88 that houses a push plate defeating device or relief mechanism 102 in its forward end. For general convenience and safety, the piston 88 and relief mechanism 102 may be positioned such that the mechanism 102 is protected within the piston before the piston is applied to the push plate inside a cartridge 16. A spring 103 urges the mechanism 102 to remain in protected position within piston 88. Advancing the pushrod overcomes the force of spring 103 to advance the mechanism 102 from the front of the piston, toward the push plate, by a limited available distance.

The push plate 18 is configured to space the material contacting front wall of the push plate forward from the piston. Where this forward spacing is greater than the limited advancement available to the mechanism 102, the relief mechanism 102 does not reach the forward wall of the push plate to vent or disable the container 15, and the container 15 is considered to be compatible with applicator 10. On the other hand, with a container 15 where the forward wall of the push plate is spaced from the piston by less than the limited advancement available to mechanism 102, the relief mechanism 102 reaches the forward wall and, in response, vents or disables the container 15. This latter type of container 15 is considered to be incompatible with applicator 10.

A suitable configuration for a compatible push plate 18 in a compatible container 15 is to have a peripheral wall 19 extended by the necessary distance toward the rear of the cartridge 16. Other types of spacers or standoffs can be used, as well, to prevent the relief mechanism from defeating the compatible push plate or cartridge. In an example, the mechanism 102 acts on the incompatible, contacted push plate to disable it by forming a hole in the incompatible push plate. An incompatible container is thereby disabled from delivering its material charge 80 to the material transfer tube 74 or nozzle. Instead, the material within the incompatible container vents backwards through the formed hole, which also alerts the operator of the spray apparatus.

According to the described scheme, a typical relief device 102 in some way punctures the push plate. One type of puncturing mechanism might be a cutter head that the pushrod can push through the front wall of an incompatible push plate. Another relief device might be a heated head that can melt a hole in an incompatible push plate, using a battery powered hot tip similar to the tip from a cordless soldering iron. Once the internal push plate in an incompatible cartridge is opened by a relief device 102, the contents 80 of the incompatible cartridge may be pushed rearward due to further advancement of piston 88 and by the backpressure from the nozzle 48 applied to the forward end of the material transfer tube. To help guide the disposal of the vented contents 80, a hollow pushrod 99 may be used to provide a rearward passage for the contents to follow. Likewise, the puncturing head of relief device 102 may be configured as a ring so that the vented contents of the incompatible cartridge can pass through the puncturing head to reach the hollow pushrod.

Figure 2:
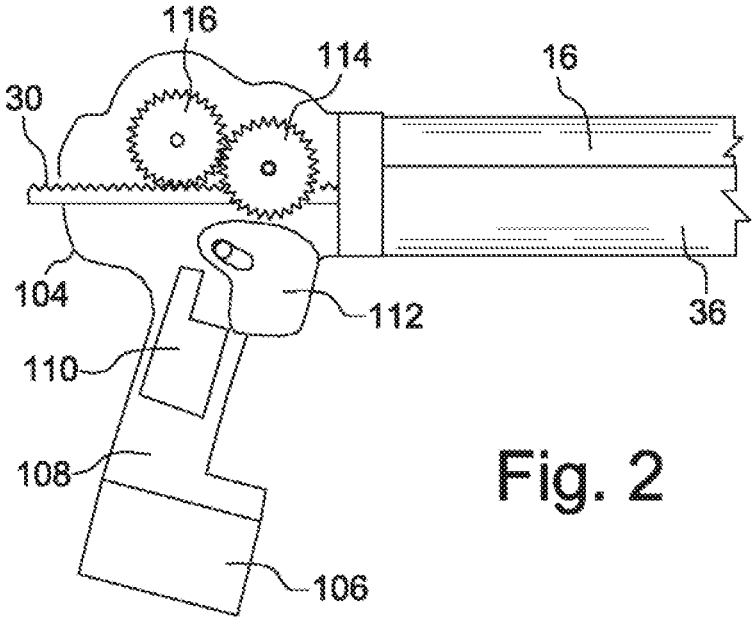
FIG. 2 is a side schematic view of a modified delivery mechanism employing electric drive to uniformly advance a pushrod.

With reference to FIG. 2, a substitute for hand pumping the distributable product 80 may employ an electric materials pump 104. A rechargeable battery 106 is carried on handle 108 and powers an electric drive motor 110 when trigger 112 is actuated. The drive motor 110 operates drive gear 114, which operates driven gear 116. The driven gear 116 engages the teeth of the pushrod 30 to advance the pushrod at a suitable speed.

As previously explained, with prior conventional sprayers there is a 30 percent waste factor because the user has to stop spraying and start spraying off-target to get an error free sprayed surface. All current spray systems waste a 30% factor, including also the airless systems. The present spray applicator assembly 10 overcomes these problems by, inter alia, providing full time back pressure that stops the errors as soon as the backpressure is not overcome by active pumping of the distributable products to be applied.

Reduction in waste factor is a significant advantage achieved in this spray applicator 10. High waste factor and other problems are unavoidable according to the technology used in prior art spray systems, which do not increase air flow to similar high velocities. According to a hypothetical, non-limiting example, the four passages 64 of the present spray application each support air speeds of 1095 feet per second or above. Preferred speed is slightly below supersonic air flow to the nozzle. The spray assembly converts 90 psi @ 5.6 cfm to such a substantial air speed and delivers it into the base of the nozzle through the four passages 64. Then, desirably, the nozzle is configured and operated to convert this high speed air into exit speed of approximately 790 ft. per second, which is subsonic, to prevent wind shear of the spray pattern in the static air between the target and the spray nozzle 78. This eliminates the waste found with many common prior art sprayers.

Making the tip 78 from a metal such as brass, like a musical instrument, appears to be important. Modern brass horns and other brass instruments often are formulated using proprietary brass recipes. Different formulations of brass content apparently achieve different resonance. Likewise, the nozzle tip 78 may resonate according to the formulation of the metal used in construction. This brass nozzle and the brass thread column 58 can add to the easy breakdown of the feed of distributable products, especially thixotropic materials, running through this assembly.

The four separate air streams 82 from corresponding four passages 64 are fed into the primary air chamber 66 at the speed achieved in the passages, estimated to be just under mach 1, or 1095 ft. per second with presently used passage and chamber sizing. Of course, the sizes of the various passages and chambers can be changed to establish higher air speeds or lower air speeds. These air streams 82 are equally spaced around the chamber 66, on equal radii from material transfer tube 74 that feeds the nozzle bore 68. Within chamber 66, the combined input of these four jets 64 acts on the material from tube 74 by applying a resonance around the material. When the passages 72 in the nozzle tip are rotated out of alignment with jets 64, resulting changes in resonance can result, with variable applications to the material from tube 74. To further enhance the effects of resonance, it may be desirable to form the nozzle assembly from multiple materials. For example, sonic-related parts might be made of brass or another resonate metal, while the rest of the nozzle might be made of a non-resonate material such as plastic. Materials transfer tube 74 beneficially might be made of brass with an expansible plastic end on it for the tube connection. Resonance can be enhanced by use of a brass materials transfer tube rather than a full plastic tube. Presently, it appears that sonic resonance is being transmitted backwards through the materials flow in the materials transfer tube as the materials to be sprayed are being pumped towards the nozzle from the materials transfer tube.

Figure 11:
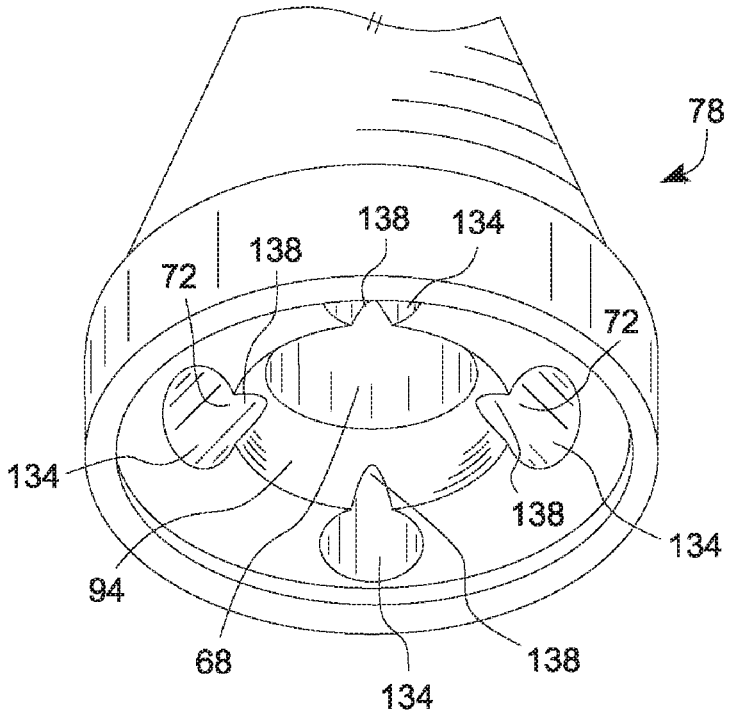
FIG. 11 is an isometric view taken from upper rear position, showing details of the nozzle.

FIG. 11 shows the rear face of the nozzle 78, showing the in-flow end 134 of the angled passages 72. The angled passages are bordered by the inner beveled surface 94 of bore 68. At the in-flow end 134, the passages 72 cut through a portion of the beveled surface 94 to define U-shaped or V-shaped flute cuts 138 that communicate between the beveled surface 94 and the passage side wall 66. The flute cuts 138 are believed to relate to sonic resonance being involved in the cause of breaking up thixotropic distributable products. The shape of the flute cuts is at an intersection between the beveled inner surface 94 and each of the diagonal cylindrical air paths 72. It has been postulated that the U-shaped or V-shaped flute cuts perform somewhat like the opening in an organ pipe or like one might carve in the bark of a willow whistle. This U-shaped or V-shaped opening appears in various sound generating instruments and may indicate the generation of supersonic sound waves by high speed air flow from primary chamber 66 into each of the air paths 72. Supersonic waves might travel from each of the four U-shaped or V-shaped openings to bevel-walled chamber 66, converging in the nozzle bore 68 where they begin to break distributable product into droplets and propel it forward. The distributable product is further broken up into smaller droplets when it is blasted again by air exiting flow paths 72. Exiting the four channels 72 will be four jets of air vibrating at the same ultra-sonic frequency, the energy of which further breaks up the distributable product into droplets before exiting the nozzle. In addition to participating in the application of ultra sonic waves, the bevel 94 also helps distributable product to travel from the larger materials feed tube 74 to the smaller barrel 68 of the nozzle tip.

Analysis of air flow through the nozzle shows the following: assuming the in-flow channels 64 have inner diameter of 3⁄16 inch, cross-sectional area is 0.11 sq. inch. Air flow is 0.84 cu. ft. per sec. Air velocity is 1095 ft. per sec. The illustrated design uses air pressure of 90 psi and converts it at passages 64 into four jets of air that are very close to supersonic speed air streams. High speed air at near supersonic speed combines with distributable product-bearing droplets.

The barrel 68 is smaller than the outlet port of distributable products feed tube 74, resulting in use of the angle. Distributable products are compressed in the barrel 68. In the barrel the four tear drop shaped exit portals 76 take up around ¾ths of the barrel circumference at their entry position inside the barrel 68. This allows distributable products to be formed by the air stream with a very effective radial contact with the airstream to finalize droplet formation. Sonic resonance levels here are predictable. When these angled tip shafts 72 are rotated out of alignment with the four column air shaft feeds 64 in the primary air chamber, the resonance is increased and back pressure is created, which holds back the distributable products in the nozzle. This aspect is what is used to set the nozzle for spraying a liquid solution like paint. Thus the same nozzle that sprays a texture compound can spray a paint compound with no changes of components in the nozzle assembly. The higher sonic levels assist in breaking up the paint into fine spray. The higher back pressure aids in controlling the forward movement of the liquid.

When distributable products pass over the angled cuts in the base of the tip 78 and pass the holes 134 in the barrel, a sonic response is created, similar to what happens in an organ or flute. When distributable products pass the four flute cuts, a further sonic response is created.

The nozzle 78 functions differently when it has distributable products within the barrel 68 of the tip versus when it is functioning without distributable products within the barrel 68 of the tip. When only the high speed air stream is in the tip, the nozzle assembly and the tip 78 act as an automatic materials flow valve or control without having an actual flow control valve in the assembly. The tip-nozzle assembly automatically shuts off forward flow when there are no distributable products present inside the nozzle tip 78. Thus, when there are no distributable products being forced into the tip 78 by the materials pump, air traveling into the tip 78 from the primary air chamber 66 takes the widest and least resistant route to go out the tip. The airstream travels up the barrel 68 of the tip, and a small amount travels up the tip's angled portal tubes 72. The heavy airstream traveling out the tip is in the barrel 68 when no distributable products are being pumped into the barrel. This airstream passes the four radially placed opposing portals 76, which are the tear drop portals in the barrel, about ⅔rds of the distance up the barrel.

When the high velocity airstream passes the portals 76, an evenly formed vacuum pocket is formed below the four opposing teardrop portals 76 in the barrel. This vacuum pocket creates within it an area of back pressure. This backpressure holds distributable products from moving evenly in the materials transfer tube 74, stops siphoning of the distributable products into the air stream, and assists with other issues that create errors when flow of distributable product is interrupted. Any reason for interruption to an even flow in a standard spray system causes errors in the spray. The present nozzle assembly allows interruption in flow of distributable products and will not create errors when interruptions occur in the flow of distributable products to the tip 78. The exit spray velocity from the nozzle 78 is approximately 790 ft. per second. This is subsonic spray from the nozzle. This means the spray is produced inside the primary air chamber 66 as the materials pass the space where the four Venturi tubes 64 in the thread column 58 release the high velocity air streams into chamber 66. The nozzle produces a spray without the use supersonic speed at the nozzle tip 78, unlike many prior known sprayers. This reduces waste to a very low factor, which results in almost no airborne contaminants bring present in the environment of the sprayer, very low fallout in a room, and minimal masking requirements.

Figure 12:
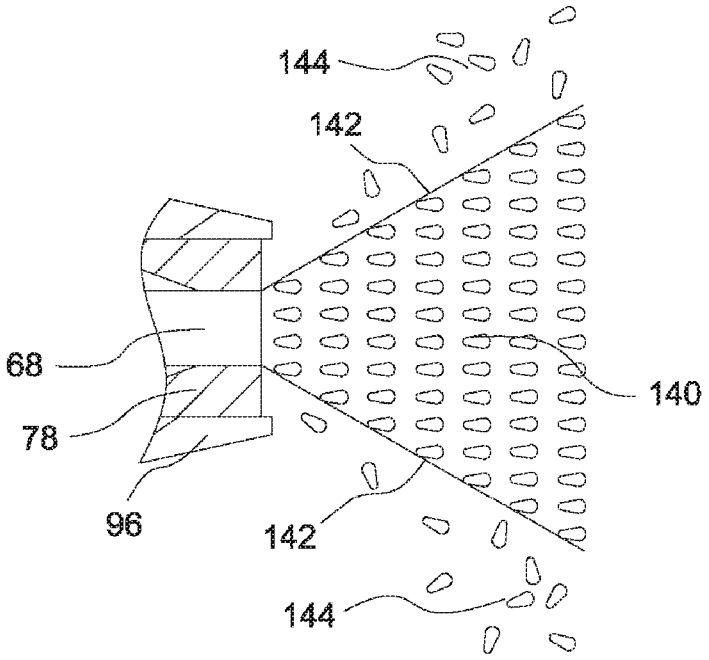
FIG. 12 is a schematic side view of the nozzle emitting a clean spray pattern with will defined edges, and also showing typical waste located outside the edges of the clean spray pattern, the latter being an example of waste produced by prior spray equipment.

The spray is made inside the nozzle assembly. Then the spray is blown out the nozzle at subsonic speeds, which lowers the air velocity of the spray and stops air from shearing the spray cone 140 as it moves to the target. As an example of a clean spray cone achieved with applicator assembly 10, FIG. 12 illustrates a very clean resulting spray cone pattern 140 with sharp edges 142. A portion of FIG. 12 also illustrates waste as found in many prior art spray devices, where peripheral droplets 144 are found outside the sharp edges of the clean spray cone 140. The spray of applicator assembly 10 is thus very stable in flight. The spray pattern edge 142 is substantial in nature and is very resistant to air shear, which otherwise is created by the spray traveling through the stagnate air in between the nozzle of the sprayer and the target. This invention is able to create spray inside the nozzle by employing substantially higher air velocities than found in prior art, whether considering airless or air-assisted technologies where the spray leaves the muzzle of the nozzle at supersonic speeds to achieve a spray.

The four airstreams 82 feeding the nozzle move at transonic speeds into the primary air chamber 66. The spray leaves the nozzle muzzle with this subsonic flow rate. This subsonic muzzle velocity is set at just under supersonic speed. This exit speed is low and thus is a substantially improved exit velocity to produce a non-shearing speed of the spray. Too high a spray velocity can create a negative effect on the materials making up a spray. The droplets will disintegrate at too high a velocity and not be an effective spray. They will become vapor and waste 144, as found in many standard air assisted nozzles that create waste of 30% of the materials being sprayed.

The present muzzle velocity spray speed is not fast enough to create the shearing problems found with many standard supersonic spray speeds from the prior art. Thus, this nozzle doesn't need to initially eject the materials and the spray at supersonic speeds to create the spray. For this reason, it differs in method of operation from other known sprayers. Prior known spray systems depend on air velocity to be able to spray. Normally, prior art nozzles depend on a compressor that delivers an air stream with sufficient air velocity by forcing the air through a nozzle with a tiny outlet orifice. This orifice increases the air velocity and propels the spray with the high pressure air stream into the air in front of the nozzle as spray. The higher the viscosity of the sprayed material, the higher air velocity is required to spray the material. High air pressure is a preamble for producing higher velocity air streams in a standard nozzle air delivery system. A large compressor is needed with prior art systems to establish a higher velocity by generating the pressure that drives the velocity.

In contrast, the present spray system generates a high velocity air stream within the nozzle bore 68. The high velocity air stream within the nozzle is converted to establish a spray. The exit speed of the combined air streams from within the nozzle 68 results in a lower spray speed that is not affected by shearing. The result is that there is no substantial waste factor. The spray nozzle has low muzzle velocity, which limits air shearing and fallout factors. The spray has a remarkably clean pattern 140.

This invention employs the thermodynamics of the Gibbs free energy as well as the Plateau-Rayleigh instability phenomena by the design and assembly of the parts to produce a spray. The natural tendency of a materials flow is to break down into droplets. The nozzle forces the materials stream to pass through a radial chamber 66, where the materials are instantly broken down into droplets by the high velocity air stream. This reaction creates a spray in the primary air chamber 66. The invention transmits the sonic resonance backwards into the materials flowing in the passages of the nozzle, including the materials transfer tube 74. The materials transfer tube enhances the Plateau-Rayleigh Instability by design. The materials in the conduit absorb the sonic resonance within the materials transfer tube. This enhances the materials flow break down. When the materials flow enters the chamber 66 where the four high speed air outlets are located, it has been processed by sonic resonance and can be broken up with ease. Thus the sonic resonance within the brass assembly has another benefit to this invention.

The nozzle 78 transforms the material flow to spray when it is hit with the four supersonic air jets 82 in the resonance chamber 66. Combined supersonic air inlets in the nozzle create spray that leaves the nozzle at a lower spray exit speed that is subsonic in nature, of approximately 790 feet per second. The spray is leaving the nozzle at subsonic speeds. The subsonic speed is not sensitive to high air shearing.

The air speed inside the primary air chamber 66 is due to four air ports from passages 64 feeding 1095 ft. per sec. air, and it has an enhanced resonance level, also. The resonance levels are undetermined but exist. The nozzles ability to break up heavy thixotropic materials into spray is enhanced. The chamber is round and has four high speed air injectors in the base of the radius of the chamber. The air is radially breaking up the materials as they pass the chamber onto the nozzle's barrel by extreme air turbulence at 1095 ft. per. sec. Each port blasts the materials to droplets instantly as they pass the primary air chamber 66. This creates the spray.

The spray applicator 10 is effective to deliver combustible material. This spray nozzle has been tested for delivery of fuel such as diesel fuel. The spray apparatus 10 showed an ability to function with chilled diesel fuel. The described technology may offer an improvement in fuel injectors. Particularly when delivering a combustible material of any description that may burn during spray function, the ability of the nozzle to cleanly shut off and clean itself is a great advantage as a safety measure to prevent flame from traveling back into the spray gun or to the source of the combustible material.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A spray applicator for receiving intermittent delivery of distributable product, receiving a stream of propellant gas, and applying said received propellant gas to spray said received distributable product during periods when the distributable product is being delivered, and cleanly terminating delivery of the distributable product during pauses in delivery of the distributable product, comprising:

a nozzle piece having a substantially uniform longitudinal nozzle bore between a front outlet end and a rear inlet end thereof;

a primary air chamber at said rear inlet end of said nozzle piece, communicating with said nozzle bore at a front side of said primary air chamber;

a pausible source of distributable product carried by said spray applicator;

a material transfer tube connected, in use, to receive distributable product from said source of distributable product and to deliver the received distributable product to the primary air chamber to be sprayed through the nozzle bore, a front end of said material transfer tube being aligned with the nozzle bore and delivering distributable product into a rear side of the primary air chamber;

a propellant gas reservoir adapted to receive therein pressurized propellant gas;

a plurality of primary gas delivery passages connected at a rear end to said reservoir to receive said pressurized propellant gas from the reservoir and connected at a front end to the primary air chamber in a substantially equally spaced pattern at the periphery of said front end of the transfer tube to deliver the propellant gas into the primary air chamber, across the front end of the transfer tube, and into the rear inlet end of the nozzle bore;

a plurality of secondary gas delivery passages communicating at a rear end to the primary air chamber to receive the propellant gas from the primary air chamber and connected at a front end to the side of the nozzle bore between front and rear ends of the nozzle bore, said secondary gas delivery passages being spaced equally around the nozzle bore, the front end of the secondary gas delivery passages being angled forwardly and centrally with respect to the nozzle bore to deliver the propellant into the nozzle bore in a converging and forward angled pattern;

wherein, in use, propellant gas being delivered through the primary gas delivery passages and the secondary gas delivery passages establishes a backpressure at the front end of the material transfer tube sufficient, during pauses in delivery of the distributable product from the source, to terminate delivery of the coating from the front end of the material transfer tube and substantially clear residual coating from the nozzle bore.

2. The spray applicator of claim 1 with adjustable spray characteristics, wherein:

said secondary gas delivery passages are rotatably carried with respect to said primary gas delivery passages such that the secondary gas delivery passages can be rotated with respect to the primary gas delivery passages between positions of mutual axial alignment and mutual axial misalignment.

3. The spray applicator of claim 2, wherein:

said nozzle piece defines said secondary gas delivery passages;

a collet secures the position of rotation of the nozzle piece with respect to said primary gas delivery passages; and said collet is releasable to permit relative rotation of the nozzle piece with respect to the primary gas delivery passages.

4. The spray applicator of claim 1, wherein said intermittent source of distributable product operates with a compatible carried container of distributable product, wherein said compatible container comprises:

a cartridge body carrying a charge of distributable product;

a front end of said cartridge body carrying a junction temporarily securable to said material transfer tube for delivering distributable product from said charge into the material transfer tube;

a rear end of the cartridge body carrying a compatible push plate that is forwardly moveable to apply pressure to the charge of distributable product to advance the distributable product through the material transfer tube, said rear end of the cartridge body being open for application of forward pressure to advance said compatible push plate in the cartridge body;

the spray applicator further comprising:

a cradle configured, in use, to carry said container;

a pushrod carrying a piston sized and positioned to engage the compatible push plate, said piston carrying a puncturing head extending forward from the piston by a limited distance of puncturing head extension and configured to puncture a push plate contacting the puncturing head; and a pump driving said pushrod toward the compatible push plate;

wherein the compatible push plate carries a spacer positioned to contact the piston at a distance greater than said limited distance of puncturing head extension, whereby said spacer prevents said puncturing head from contacting the compatible push plate, thereby preventing the puncturing head from puncturing the compatible push plate, and the piston is enabled to advance the compatible push plate by pushing said spacer to advance the push plate and drive distributable product through said material transfer tube.

5. The spray applicator of claim 4, operable to disable an incompatible container from supplying the contents thereof to said spray applicator, wherein:

said incompatible container comprises a cartridge body having an open rear end carrying an incompatible push plate;

wherein said incompatible push plate is configured to be contacted by said puncturing head before other contact by said piston, whereby the puncturing head punctures the incompatible push plate and thereby establishes a puncture hole for draining contents of the incompatible container rearward through said puncture hole in the incompatible push plate.

6. The spray applicator of claim 4, wherein:

said puncturing head is a cutter head suitable, in use, to cut an incompatible push plate upon contact.

7. The spray applicator of claim 4, wherein:

said puncturing head is a high temperature head suitable to melt an incompatible push plate upon contact.

8. The spray applicator of claim 1, adapted to operate with a container of distributable product, further comprising:

a cradle equipped with a pump and pushrod, adapted to carry a container of said distributable product, and adapted for operation of said pump to drive the pushrod to advance the distributable product from said container and through said material transfer tube;

wherein the container is configured with a cartridge body carrying therein a charge of said distributable product, a front end forming a junction securable to the material transfer tube and a rear end open to entry by said pushrod and carrying a push plate suited to advance the charge of distributable product through the material transfer tube; and said pushrod carrying a piston for pushing said push plate, wherein said piston has a portion adapted to break-away at a specified pressure limit for relieving the distributable product from pressure above said limit.

9. The spray applicator of claim 8, wherein:

said container carries said push plate; and the push plate has a portion adapted to break-away at a specified pressure limit for relieving the distributable product from pressure above said limit.

10. The spray applicator of claim 9, wherein:

said break-away portion of said push plate and said break-away portion of said piston are located in alignment at the respective centers of the push plate and piston so as to enable simultaneous break-away of both said break-away portions.

11. The spray applicator of claim 8, wherein:

said pushrod is hollow for receiving and rearwardly channeled relieved distributable product from said break-away portion of said push plate.

12. The spray applicator of claim 1, wherein:

said reservoir is connected to an inlet line adapted, in use, to connect to a compressor supplying said propellant gas under pressure through said inlet line and into the reservoir;

said primary gas delivery passages are sized narrower than the reservoir by at least an order of magnitude, such that in use, propellant gas flows through the primary gas delivery passages at substantially higher velocity than through the reservoir.

13. The spray applicator of claim 1, wherein:

said secondary gas delivery passages are disposed at a forward and central angle in the range from 26 to 28 degrees relative to the longitudinal centerline of the nozzle bore.

14. The spray applicator of claim 1, wherein:

said supply source of said distributable product comprises a container having a cartridge body carrying a charge of said distributable product, said cartridge body having a spout on a front end thereof forming a junction securable to said material transfer tube for transmitting the charge of distributable product to the material transfer tube;

said reservoir is configured with a port at a rear end thereof, said port carrying an elastic ring with a central tube-receiving hole sized to receive a back end of the material transfer tube;

the material transfer tube traverses said reservoir, and a back end of the material transfer tube extends through said tube-receiving hole;

said spout has a nose portion sized smaller than said back end of the material transfer tube, such that said nose portion enters the back end of the material transfer tube without stretching the material transfer tube; and rearward of said nose portion, the spout defines a forward taper sized to fit within said back end of the material transfer by expanding the back end of the material transfer tube and compressing said elastic ring against the port, thereby forming said junction securable to the material transfer tube.

15. The spray applicator of claim 1, wherein said source of distributable product carried by said spray applicator comprises:

a trigger operated hand pump, pausing delivery of said distributable product between sequential operations of the trigger.

16. The spray applicator of claim 1, wherein:

said distributable product is chosen from the group consisting of combustible materials, coating materials, liquids, and thixotropic materials.

17. The spray applicator of claim 1, wherein:

said distributable product is thixotropic material;

further comprising:

a local container formed of a cartridge body carrying a charge of said thixotropic material;

the spray applicator further comprising a cradle positioned, in use, to carry said local container in suitable alignment with said material transfer tube for a front end of said cartridge body to form a sealed junction secured to the material transfer tube for delivering said thixotropic material from said local container into the material transfer tube.

18. A spray applicator, comprising:

a nozzle piece having a substantially uniform longitudinal nozzle bore between a rear inlet end thereof and a front outlet end;

a primary air chamber at said rear inlet end of said nozzle piece, communicating with said nozzle bore at a front side of said primary air chamber;

a propellant gas reservoir located at the back side of said primary air chamber, adapted to contain therein a propellant gas under pressure;

a source of propellant gas, in use delivering said propellant gas into said propellant gas reservoir under pressure;

an adjustable pressure metering valve located between said source of propellant gas and said reservoir;

a material transfer tube traversing said propellant gas reservoir between front and back sides thereof, a front end of said material transfer tube being aligned with the nozzle bore at the rear side of the primary air chamber;

a source adapted, in use, to supply distributable product to said material transfer tube at a rear end thereof for delivery through the material transfer tube to the primary air chamber, and said source being pausible;

a plurality of primary gas delivery passages formed in a front wall of said propellant gas reservoir, in use transmitting propellant gas from the propellant gas reservoir to the primary air chamber while accelerating the propellant gas;

wherein said plurality of primary gas delivery passages is arranged in an equally spaced pattern around the periphery of said front end of the material transfer tube, in use delivering the accelerated propellant gas across the front end of the transfer tube, thereby establishing a backpressure for, in use during a pause in delivery of distributable product from said source, substantially dripless cutoff of distributable product delivery to the nozzle bore;

a plurality of secondary gas delivery passages communicating at a first end thereof with the primary air chamber, in use to receive the propellant gas under the suitable pressure therefrom, said secondary gas delivery passages being arranged around the nozzle bore in a substantially equally spaced pattern and angled forwardly and centrally with respect to the nozzle bore, in use to deliver the propellant gas into the nozzle bore in a converging and forward angled pattern of a second end of the secondary gas delivery passages, in use during a pause in delivery of distributable product from said source substantially clearing residual coating from the nozzle bore.

19. The spray applicator of claim 18, wherein:

said source of distributable product comprises a container having a cartridge body carrying therein a charge of said distributable product, said cartridge body having a spout at a front end thereof, suitable in use to form a junction with the material transfer tube for transmitting the charge of distributable product to the material transfer tube;

said propellant gas reservoir is configured with a port at a rear end thereof, said port carrying an elastic ring with a central tube-receiving hole sized to receive a back end of said material transfer tube;

the material transfer tube traverses said propellant gas reservoir, and a back end of the material transfer tube extends into said tube-receiving hole;

said spout has a nose portion sized smaller than said back end of the material transfer tube, such that, in use, said nose portion enters the material transfer tube without stretching the material transfer tube; and rearward of said nose portion, the spout has a forward taper sized to fit within said back end of the material transfer by expanding the back end of the material transfer tube and compressing said elastic ring against the port, thereby forming said junction securable to the material transfer tube.

* * * * *